US008387830B2

(12) United States Patent
Proper et al.

(10) Patent No.: US 8,387,830 B2
(45) Date of Patent: Mar. 5, 2013

(54) DISPENSER WITH LOCKOUT DEVICE

(75) Inventors: Scott T. Proper, Stow, OH (US); Kenneth Corby, Rochester, NY (US)

(73) Assignee: GOJO Industries, Inc., Akron, OH (US)

( * ) Notice: Subject to any disclaimer, the term of this patent is extended or adjusted under 35 U.S.C. 154(b) by 337 days.

(21) Appl. No.: 12/855,139

(22) Filed: Aug. 12, 2010

(65) Prior Publication Data

US 2011/0056987 A1 Mar. 10, 2011

Related U.S. Application Data

(60) Provisional application No. 61/233,163, filed on Aug. 12, 2009.

(51) Int. Cl.
*B67B 1/00* (2006.01)
*B67D 7/06* (2010.01)
*G08B 13/14* (2006.01)

(52) U.S. Cl. ..... 222/153.13; 222/153.01; 222/181.1; 222/181.3; 340/572.1

(58) Field of Classification Search ..... 222/181.1, 222/181.3, 23, 153.01, 384, 153.13; 340/572.1, 340/603; 70/63, 278.7, 279.1
See application file for complete search history.

(56) References Cited

U.S. PATENT DOCUMENTS 4,648,638 A * 3/1987 McKnight ..... 292/144
6,343,714 B1 * 2/2002 Tichenor ..... 222/153.11
6,619,512 B1 9/2003 Sayers
7,028,861 B2 4/2006 Sayers et al.
7,165,699 B2 * 1/2007 McGill ..... 222/63
7,270,135 B2 9/2007 Virgilio et al.
7,617,703 B2 * 11/2009 Osvatic ..... 68/12.26
7,690,231 B1 * 4/2010 Field et al. ..... 70/283
7,717,028 B2 * 5/2010 Serra ..... 99/339
8,009,015 B2 * 8/2011 Sayers et al. ..... 340/5.64
8,230,888 B2 * 7/2012 Crossdale et al. ..... 141/18
2003/0172694 A1 * 9/2003 Miller et al. ..... 70/303 A
2004/0104580 A1 * 6/2004 Spiessl et al. ..... 292/84
2006/0124662 A1 6/2006 Reynolds et al.
2007/0234503 A1 10/2007 Krebs et al.

FOREIGN PATENT DOCUMENTS

EP 1346945 A1 9/2003

* cited by examiner

*Primary Examiner* — Paul R Durand
*Assistant Examiner* — Matthew Lembo
(74) *Attorney, Agent, or Firm* — Renner Kenner Greive Bobak Taylor & Weber

(57) ABSTRACT

A dispenser housing that receives a refill unit including a container and pump associated with the container to pump contents from the container. The dispenser housing includes an actuator carriage moveable between a rest position and an actuated position. The dispenser housing also includes a lockout device moveable between an open position and a closed position. When the lockout device is in the open position, the actuator carriage is movable, and, when the lockout device is in the closed position, movement of the actuator carriage is blocked by the lockout device such that the actuator carriage cannot be moved from the rest position to the actuated position.

15 Claims, 9 Drawing Sheets

DISPENSER WITH LOCKOUT DEVICE

RELATED APPLICATIONS

This application claims priority from U.S. provisional patent application Ser. No. 61/233,163 filed on Aug. 12, 2009, which is incorporated herein by reference in its entirety.

TECHNICAL FIELD

The present invention generally relates to dispensers of the type having a dispenser housing that receives a container filled with a product to be dispensed. More particularly, the present invention relates to dispensers that employ a lockout device for controlling operation of pump mechanisms that are typically carried by the container as part of a refill unit. Most particularly, the present invention relates to dispensers including a slide bar assembly for limiting the operation of a dispenser pump.

BACKGROUND OF THE INVENTION

Various dispensers are known and used to dispense fluids such as lotions, soaps and sanitizers, whether as liquid or foam. These dispensers generally include a dispenser housing that is adapted to receive refill units that carry the product that is to be dispensed. The refill units typically include a container, such as a bag or bottle, containing the product, and a pump is associated with the container such that, upon actuation, product is advanced from the container to an outlet of the dispenser. When a refill unit is emptied of product, it is removed, and a new, full refill unit is installed in the dispenser housing. To make efficient use of the volume within the housing, in terms of the amount of product that can be held therein, the container of the refill unit is often sized or contoured to fit intimately within a particular dispenser housing. Similarly, the pump portion of the refill unit is sized to fit within the dispenser housing so as to be operable by actuation mechanisms carried by the dispenser housing. Thus, the refill units are specifically sized and shaped to correspond to certain dispenser housings.

It is desirable to provide refill units that may only be used in a particular, intended dispenser housing. This can be achieved by designing specific dispenser housings that receive specific refill units. For instance, if one desires to place a sanitizer dispenser in a public restroom, a dispenser housing can be designed to have an interior that is specifically shaped to receive only an appropriately-shaped refill unit, and the manufacturers of the dispenser and refill unit can take steps to ensure that appropriately shaped refill units contain only sanitizer. By using such a paired, or associated, dispenser and refill unit arrangement, it can reasonably be assured that the maintenance staff responsible for maintaining the dispenser will only replenish the dispenser with an appropriate refill unit containing an appropriate product.

Keying systems can also be employed to ensure that only refill units of a particular product are installed in a particular intended dispenser housing. In such systems, the dispenser housing is provided with a keying system that is designed to only receive refill units having a corresponding, or complimentary, property recognized by the keying system. For instance, the dispenser housing may include a receiver for receiving a refill unit, wherein the receiver includes a star-shaped keyway. Refill units intended to be used with that particular dispenser housing would then be manufactured to have a star-shaped key positioned so that the star-shaped key fits into the star-shaped keyway when the refill unit is properly installed in the dispenser housing. Certain embodiments of electronic keying systems are also known in the art, such as those described in the jointly owned U.S. Pat. No. 7,028,861 and in the jointly owned U.S. Pat. Pub. No. 2006/0124662.

By employing the above methods, it is possible to reduce the likelihood that a refill unit containing the wrong product will be installed in a given dispenser housing. Unfortunately, some of these methods can be bypassed, and refill units with inappropriate or unintended product can be installed into some of these types of dispensers. Thus, the need exists for a dispenser having a feature to control or limit the operation of the dispenser depending on whether an appropriate refill unit is present in the dispenser housing.

SUMMARY OF THE INVENTION

In light of the foregoing, it is a first aspect of the present invention to provide a dispenser having a lockout device.

It is another aspect of the present invention to provide a dispenser having a lockout device, as above, for selectively limiting the operation of the dispenser.

It is still another aspect of the present invention to provide a dispenser having a lockout device, as above, that prevents the dispenser from dispensing product contained in an inappropriate refill unit.

In general, a dispenser having a lockout device according to the present invention has a housing that receives a refill unit that includes a container and pump associated with the container to pump contents from the container. The dispenser housing includes an actuator carriage moveable between a rest position and an actuated position. When a refill unit is received in the dispenser housing, movement of the actuator carriage from the rest position to the actuated position actuates the pump of the refill unit. The dispenser housing also includes a lockout device moveable between an open position and a closed position. When the lockout device is in the open position, the actuator carriage is moveable from the rest position to the actuated position, and when the lockout device is in the closed position, movement of the actuator carriage is blocked by the lockout device such that the actuator carriage cannot be moved from the rest position to the actuated position In any embodiment of the dispenser housing, an engagement tab may extend from the actuator carriage and a stop tab may extend from the lockout device. When the lockout device is in the open position, the engagement tab and the stop tab are unaligned in the direction of travel of the actuator carriage as it moves from the rest position to the actuated position, and, when the lockout device is in the closed position, the engagement tab and the stop tab are aligned in the direction of travel of the actuator carriage as it moves from the rest position toward the actuated position, the alignment of the engagement tab and the stop tab preventing the movement of the actuator carriage from the rest position to the actuated position due to contact between the engagement tab and stop tab.

In any embodiment of the dispenser housing, the lockout device may include a slide bar and a notch in the slide bar. The latch has a tooth that selectively engages the notch, wherein, when the tooth engages the notch, the lockout device is held in the open position, and, when the tooth is disengaged from the notch, the lockout device is forced to the closed position.

In any embodiment of the dispenser housing, the lockout device may include a spring. The spring imparts a biasing force on the slide bar, wherein when the tooth of the latch is disengaged from the notch, the spring moves the slide bar and the lockout device is forced to the closed position.

In any embodiment of the dispenser housing, the lockout device may include a shape memory alloy wire. The shape memory alloy wire causes the latch to disengage from the notch when a current is applied to the shape memory alloy wire, the current causing the shape memory alloy wire to change shape.

In any embodiment of the dispenser housing, the latch may have an irregular cam shape and may be pivotable about an axis.

In any embodiment of the dispenser housing, the lockout device may include a wire mount, wherein the shape memory alloy wire extends between the wire mount and the latch.

In any embodiment of the dispenser housing, the shape memory alloy wire is attached to the latch above the axis.

In any embodiment of the dispenser housing, the latch may include a latch post, the shape memory alloy wire extend from the wire mount and wrapping around the latch post.

In any embodiment of the dispenser housing, the shape memory alloy wire has a first and a second end. The shape memory alloy wire extends from the wire mount proximate the first end, wraps around the latch post, and is attached to the wire mount proximate the second end.

In any embodiment of the dispenser housing, the dispenser housing may include a controller, the controller controlling the current applied to the shape memory alloy wire.

In any embodiment of the dispenser housing, the dispenser housing may include an RFID receiver associated with the controller. The RFID receiver is configured to provide instruction signals to the controller based on the nearby presence of an appropriate RFID tag.

In any embodiment of the dispenser housing, when the refill unit is an appropriate refill unit, the actuator carriage is moveable between the rest position and the actuated position, and when the refill unit is an inappropriate refill unit, the lockout device is in the closed position and the alignment of the engagement tab and the stop tab prevent the movement of the actuator carriage from the rest position to the actuated position.

In any embodiment of the dispenser housing, the dispenser housing may include an opening bar for opening the dispenser housing and a reset arm. The opening bar includes a track surface and the reset arm has a guide pin, and the guide pin rides in the track surface.

In any embodiment of the dispenser housing, the lockout device may include a slide bar having a reset notch. When the opening bar is moved upwardly, the reset arm is caused to come into contact with and bear against the reset notch.

BRIEF DESCRIPTION OF THE DRAWINGS

Various features and advantages of the present invention will become better understood with regard to the following description, appended claims, and accompanying drawings wherein:

DETAILED DESCRIPTION OF THE INVENTION

Figure 1:
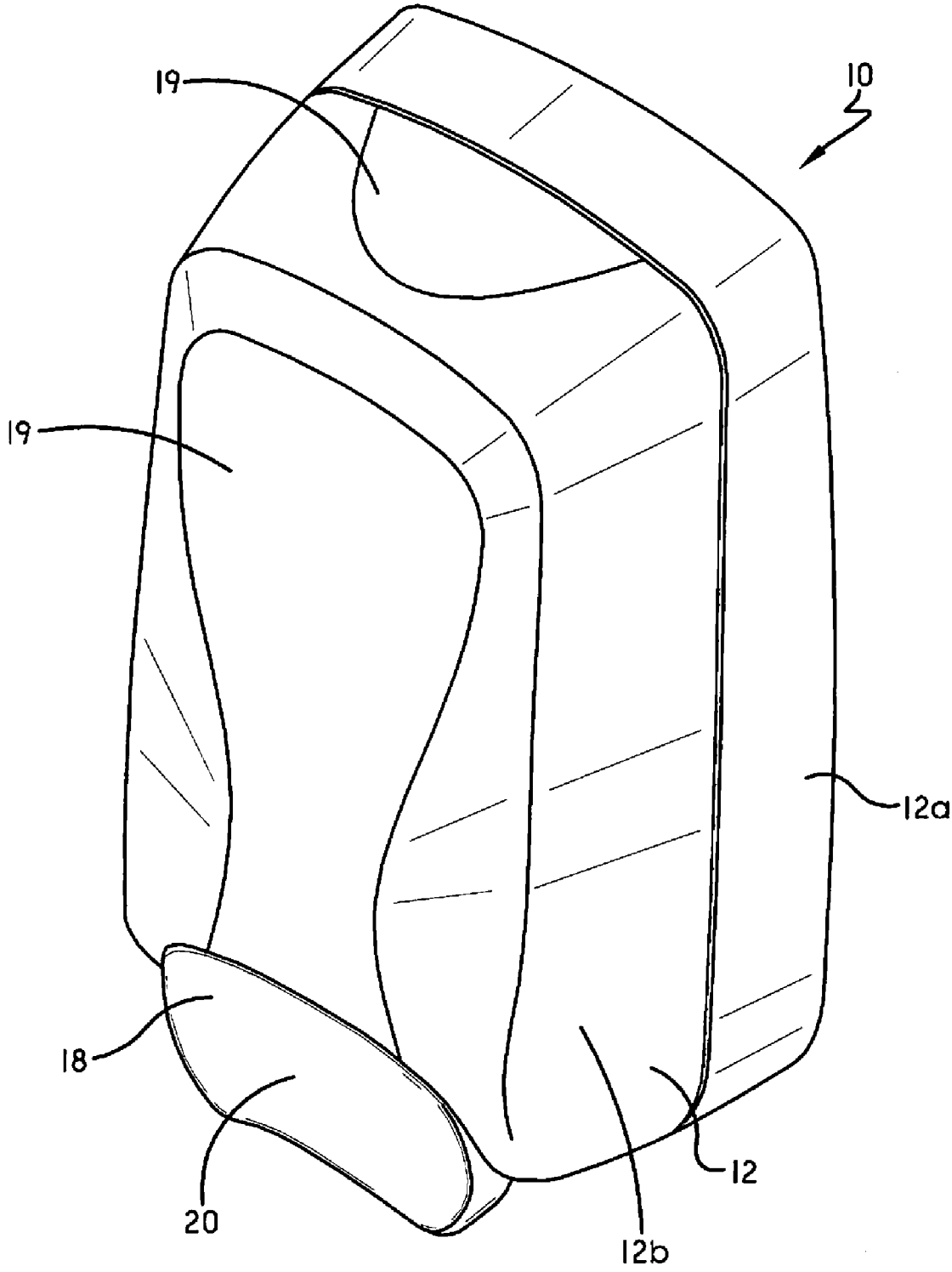
FIG. 1 is a perspective view of a dispenser according to the concepts of the present invention.

A dispenser, generally indicated by the numeral 10, is depicted in FIG. 1 of the drawings. Dispensers are widely available in the art and the dispenser 10 depicted in FIG. 1 is one non-limiting example of one of the many dispensers to which this invention may apply. The dispenser generally includes a housing 12 that defines a recess 14 (FIG. 2) that creates a volume within the dispenser 10 for receipt of a refill unit 15, which typically includes a container 16 and an associated pump 17. The container 16 holds the product S that is to be dispensed upon actuation of the dispenser 10, and, in this embodiment, is shown as a rigid bottle, though other containers can be used, as known, such as a collapsible bag, or a bag-in-box system. The housing 12 may include a backplate 12*a* and a cover 12*b* which may be hingedly attached to each other, allowing for an open and closed position of the cover 12*b* in relation to the backplate 12*a* to facilitate replacement of an empty container 16.

Figure 2:
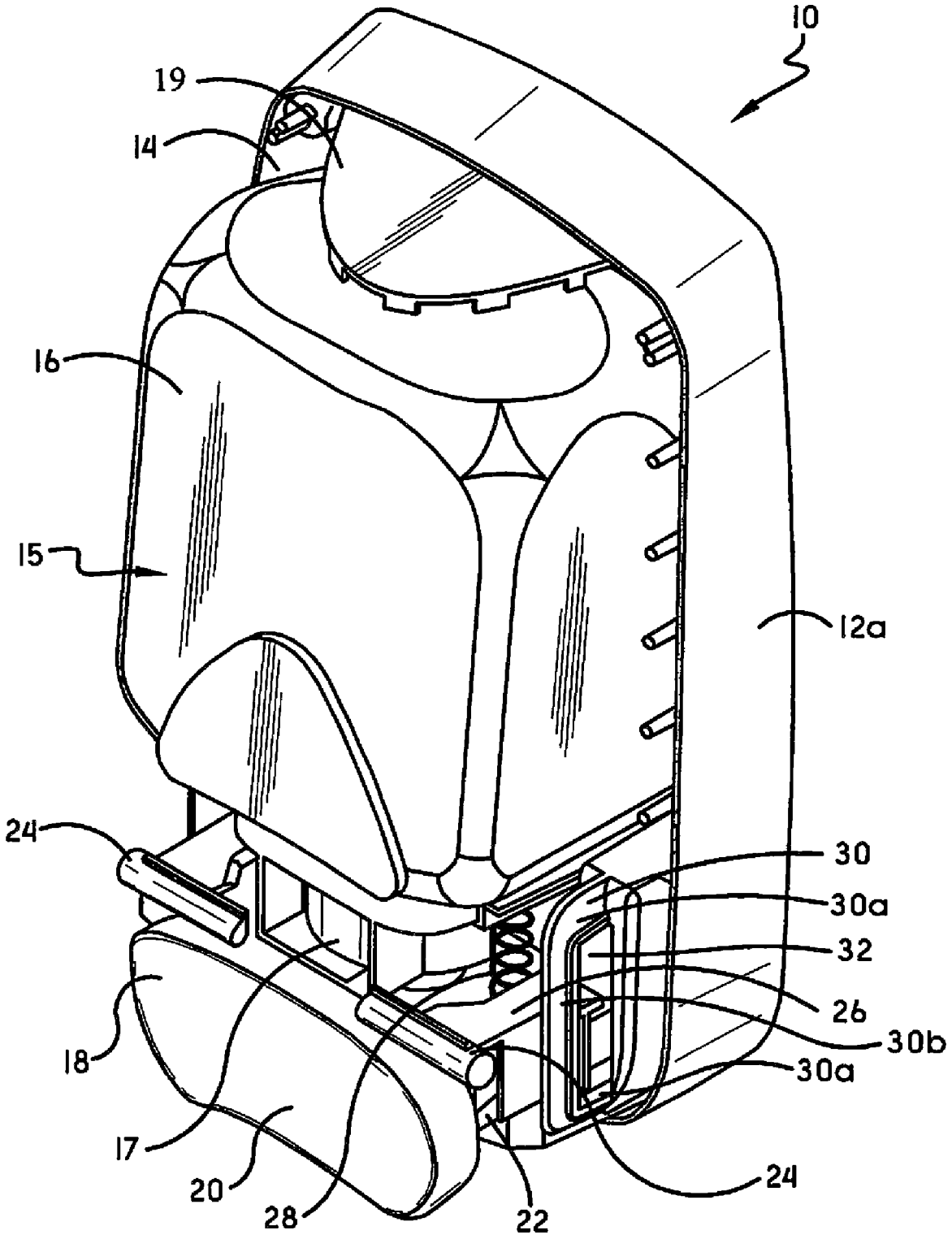
FIG. 2 is a perspective view of the dispenser of FIG. 1 with the housing cover removed.

As shown in FIG. 2, the backplate 12*a* may define the recess 14 creating a volume into which at least a portion of a container 16 is received. In addition, portions of the backplate 12*a* and cover 12*b* are configured to accommodate the pump 17 and provide actuation mechanisms suitable to operate the pump 17 as a user desires. The general interaction between refill units and housings of all types is well known. Housing 12 may optionally include suitably transparent viewing windows 19 to allow a user to look through the backplate 12*a* or cover 12*b* and view the contents of container 16.

Dispenser 10 also includes various components used in its operation, including a pushbar 18 having a user interface surface 20 and arms 22 extending from the backside of the pushbar 18 to engage an actuator carriage 26. The actuator carriage 26 is engaged with the pump 17 of the refill unit 15 so that movement of the actuator carriage 26 results in movement of mechanisms of the pump 17. In operation, a user presses pushbar 18 at interface surface 20 so that it pivots at a hinge 24, and arms 22 move the actuator carriage 26 and thus operate the pump 17 to dispense product to the user. Actuator carriages are well known in the art and actuator carriage 26 is typical of known actuator carriages, and includes structural features, such as channels, for interfacing with arms 22 of pushbar 18. Other methods of manually facilitating the dispensing of materials from dispensers are also well known.

As shown in the embodiment illustrated in FIG. 2, actuator carriage 26 is biased toward a position away from container 16 by springs 28. In this position, the actuator carriage 26 allows the pump 17 to rest in an unactuated position. Dispenser 10 also includes track guides 30 that define pathways in which the actuator carriage 26 travels. As shown in FIG. 2, track guides 30 include generally horizontally extending portions 30*a* which extend outwardly from backplate 12*a*, and generally vertically extending portions 30*b* connecting portions 30*a*. Generally vertically oriented pathways 32 are thus defined between track guides 30 and the proximate features of backplate 12*a*. Movement of actuator carriage 26 may thus be confined to pathways 32. Actuator carriage 26 also includes engagement tabs 34, which will be discussed more fully below and which may be seen in FIGS. 7A and 7B.

Figure 3:
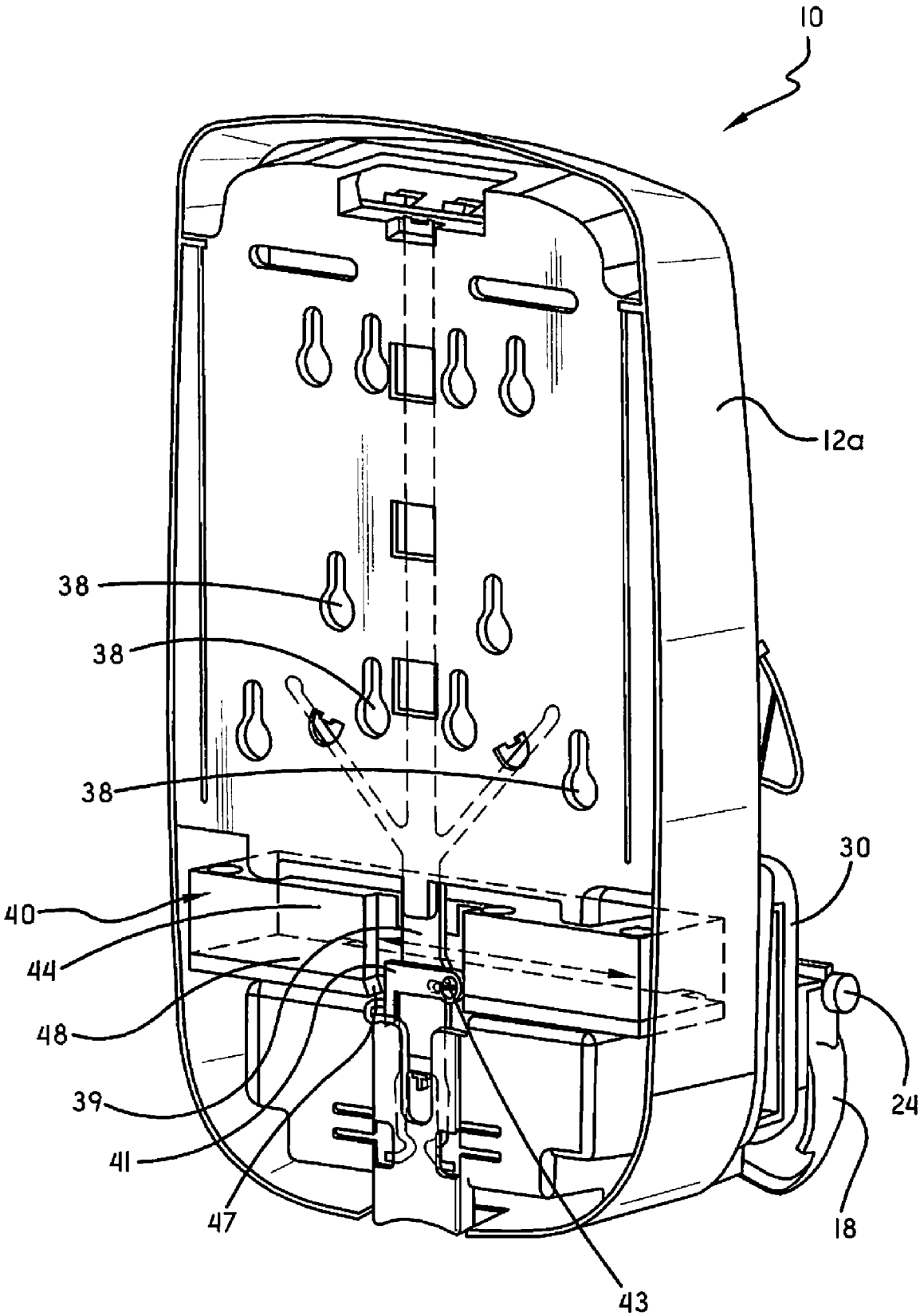
FIG. 3 is perspective view of the dispenser of FIG. 2 showing the rear of the dispenser.

Turning to FIG. 3, the rear side of dispenser 10 is shown, with backplate 12*a* including a plurality of mounting holes 38 that may be used to mount dispenser 10 onto a surface, such as a wall. Of course, it will be appreciated that dispenser 10 may be mounted onto a surface by other means, including, for instance, double-sided tape, or might be designed to be free-standing or mounted to or below a counter or any other desired surface. Dispenser 10 also includes an opening bar 39 positioned on the rear side of dispenser 10 and extending in a generally vertical direction between roughly the bottom and the top of backplate 12*a*. Opening bars are well known in the art and are moved in the vertical direction and permit a user to open a dispenser to gain access to the interior components of the dispenser and replace an empty container within the dispenser. In the embodiment shown, opening bar 39 allows a user to disengage cover 12*b* from backplate 12*a*, allowing the cover 12*b* to hingedly rotate away from backplate 12*a*, giving a user access to the space within the housing 12 of dispenser 10, thereby facilitating replacement of an empty container 16. Thus, a user operates opening bar 39 when servicing dispenser 10 and replacing an empty container 16. Dispenser 10 also includes an L-shaped reset arm 41 that is pivotally connected thereto by a rotation pin 43, about which reset arm 41 is free to rotate, on the rear side of backplate 12*a*. The structural and functional relationship between reset arm 41, opening bar 39 and other components of dispenser 10 will be discussed further below.

In the absence of any impediment to its operation, dispenser 10 functions as follows, which functioning will be familiar to those of skill in the dispenser arts. Dispenser 10 is mounted on a surface, such as a wall. A container 16 holding soap is installed into dispenser 10 according to well known methods. A user presses on surface 20 of pushbar 18, which pivots at 24. The rotational movement of pushbar 18 includes a vertical movement component, which is transferred to actuator carriage 26 through arms 22. Arms 22 are in contact with actuator carriage 26, and as arms 22 move rotationally in the upward direction, actuator carriage 26 is moved upwardly against the biasing force of springs 28. It will be appreciated that the vertically oriented pathways 32 restrict the movement of actuator carriage 26 to the generally vertical direction. As actuator carriage 26 is moved upward toward container 16, and the pump 17 associated with the container is actuated, causing a portion of product S to be dispensed from the container 16. The user then removes the pressure on surface 20, and the biasing force of springs 28 pushes actuator carriage 26 downward away from container 16. Actuator carriage 26, in turn, pushes downward on arms 22 of pushbar 18, thereby rotating pushbar 18 and returning it to its starting position. The pump 17 will also typically include a biasing mechanism (e.g. spring) that can also provide some of this return force.

The present invention, however, incorporates a lockout device to selectively limit this type of operation of the dispenser, and thereby prevent its operation and dispensing of soap.

From the rear view of FIG. 3, it can be seen that a slide box assembly 40 is incorporated into dispenser 10 and is situated within backplate 12*a* below the area where a container may be situated and generally proximate the components used in operation of the dispenser, including actuator carriage 26. Slide box assembly 40 serves as a lockout device to selectively limit the operation of dispenser 10.

Figure 4:
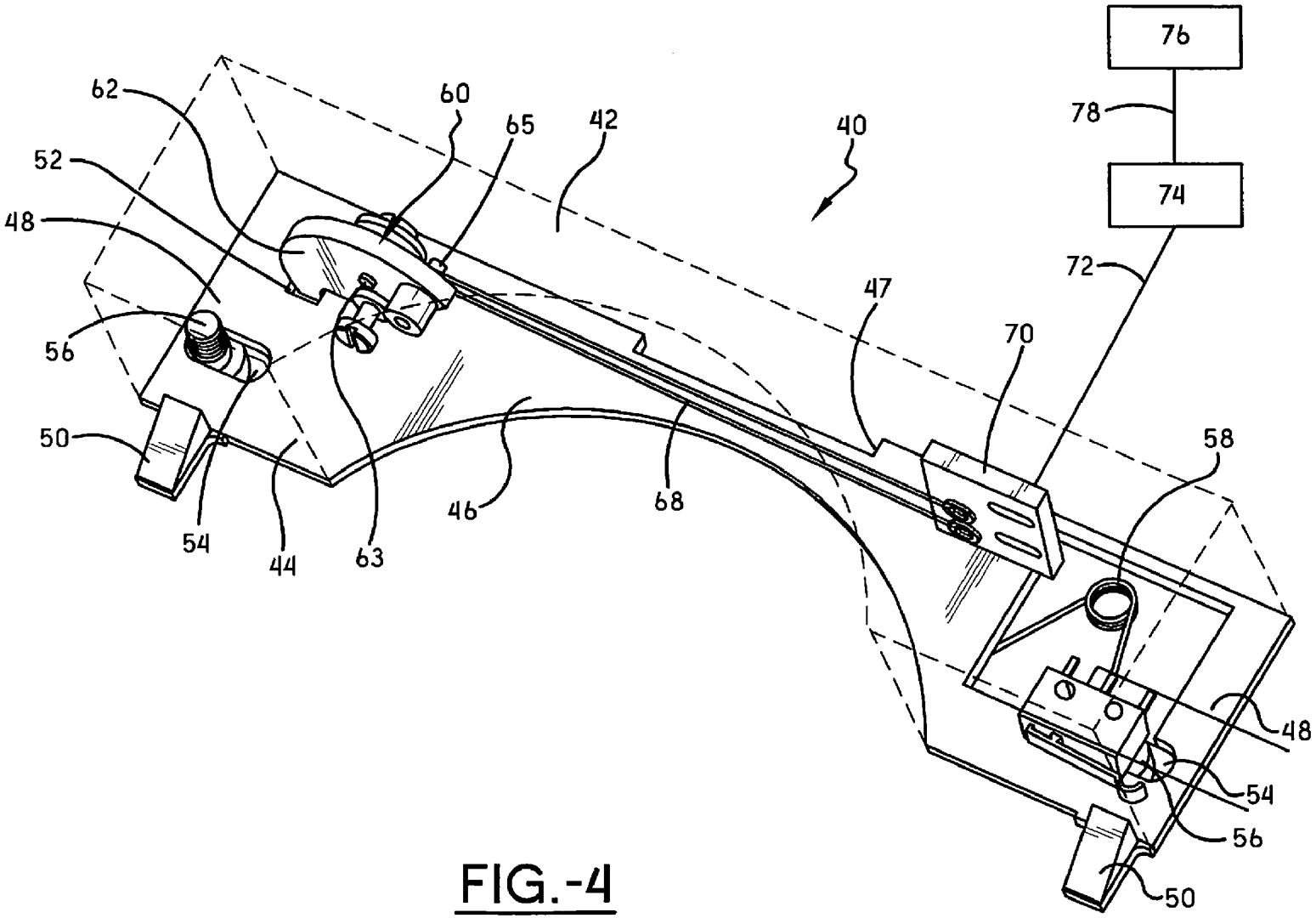
FIG. 4 is a perspective view of a slide box assembly used in a dispenser constructed according to the concepts of the present invention.

As best seen in FIG. 4, slide box assembly 40 is shaped to fit within housing 12 and has a generally flat back surface 42 and a front surface 44 having a generally curved region 46 designed to accommodate the shape of a portion of container 16. Of course, the particular shape of assembly 40 is of little consequence and may be modified depending on the housing or container with which it is associated. Assembly 40 includes a slide bar 48 that is moveable in the lateral direction (as indicated by the arrow in FIG. 3). Slide bar 48 includes stop tabs 50 extending beyond front surface 44. Slide bar 48 also includes a notch 52 and generally elliptically shaped apertures 54. Positioning screws 56 extend through apertures 54, which together help define the extent of lateral movement of slide bar 48, as will be described more fully below. A torsion spring 58 is connected to slide bar 48 and keeps it under a constant biasing force, with a component of this force being in the direction of lateral movement. Slide bar 48 also includes a reset notch 47 on the side opposite curved region 46.

Notch 52 is positioned on slide bar 48 to be engaged by latch mechanism 60 of assembly 40. As shown in FIG. 4, the irregular cam-shaped latch mechanism 60 includes a latch tooth 62 that engages notch 52. Latch tooth 62 is rotatably moveable about an axis 63 and may be rotated to come out of engagement with notch 52. A small biasing torque may be applied to latch mechanism 60 in the direction of notch 52 to bias latch tooth 62 to rotate toward and be in engagement with notch 52. As discussed, slide bar 48 is moveable in the lateral direction. FIG. 4 shows latch tooth 62 engaged with notch 52 and slide bar 48 in a first, or open position for slide bar 48. When latch tooth 62 is rotated and comes out of engagement with notch 52, the biasing force of torsion spring 58 pushes slide bar 48 in the lateral direction toward latch mechanism 60, and into a second, or closed position for slide bar 48.

Figure 5:
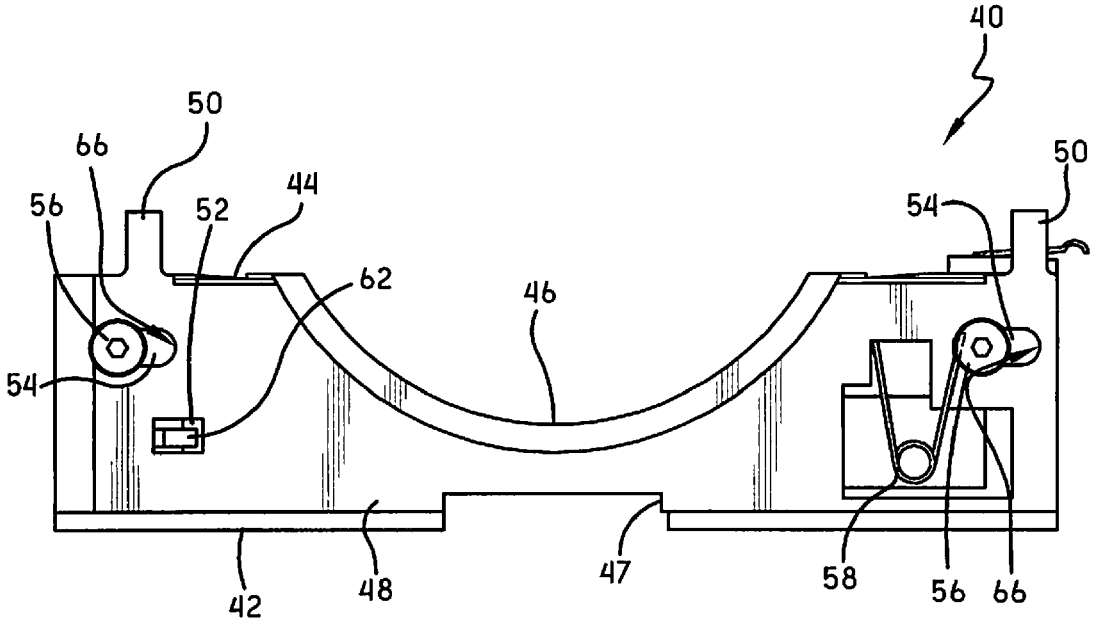
FIG. 5 is a bottom plan view of the slide box assembly of FIG. 4 with the slide bar in a first, or open, position.
Figure 6:
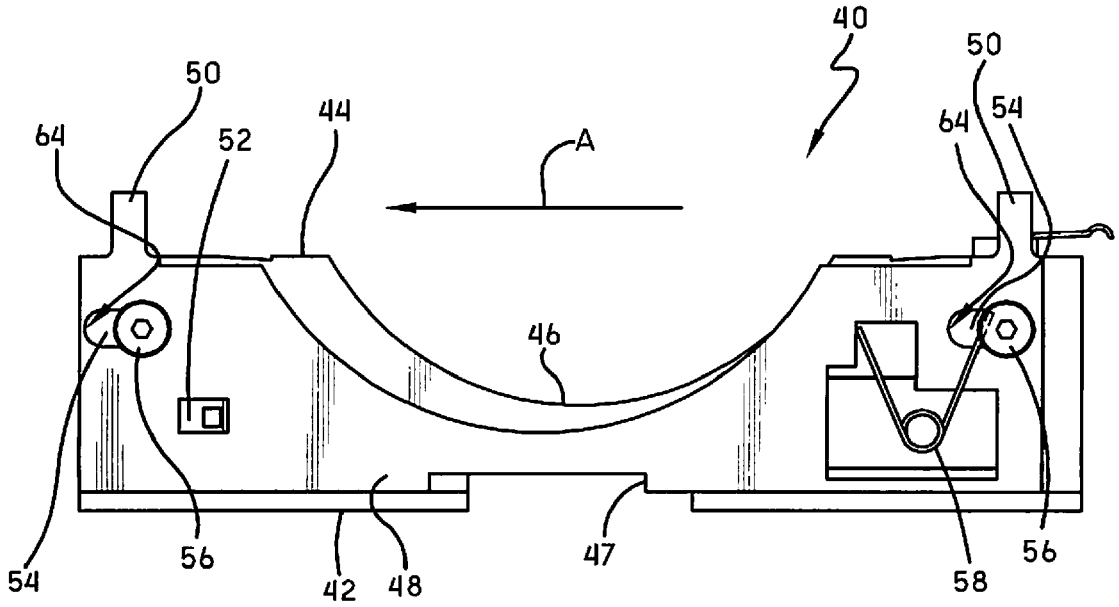
FIG. 6 is a bottom plan view similar to FIG. 5, but with the slide bar in a second, or closed, position.

FIG. 5, which is a view from the bottom of assembly 40, shows slide bar 48 in the open position. FIG. 6, which is also a view from the bottom of assembly 40, shows slide bar 48 in the closed position, with slide bar 48 moved in the lateral direction indicated by the arrow. FIGS. 5 and 6 show how positioning screws 56 and apertures 54 limit the extent of lateral movement of slide bar 48. In FIG. 5, showing slide bar 48 in the open position, slide bar 48 is positioned as far as possible in the direction opposite the arrow so that the left-most surface 64 of apertures 54 is in contact with screws 56. In turn, when slide bar 48 is in the closed position as shown in FIG. 6, the right-most surface 66 of apertures 54 is in contact with screws 56. Clearly, the extent of lateral movement of slide bar 48 may be controlled through appropriate sizing of apertures 54.

Figure 7A:
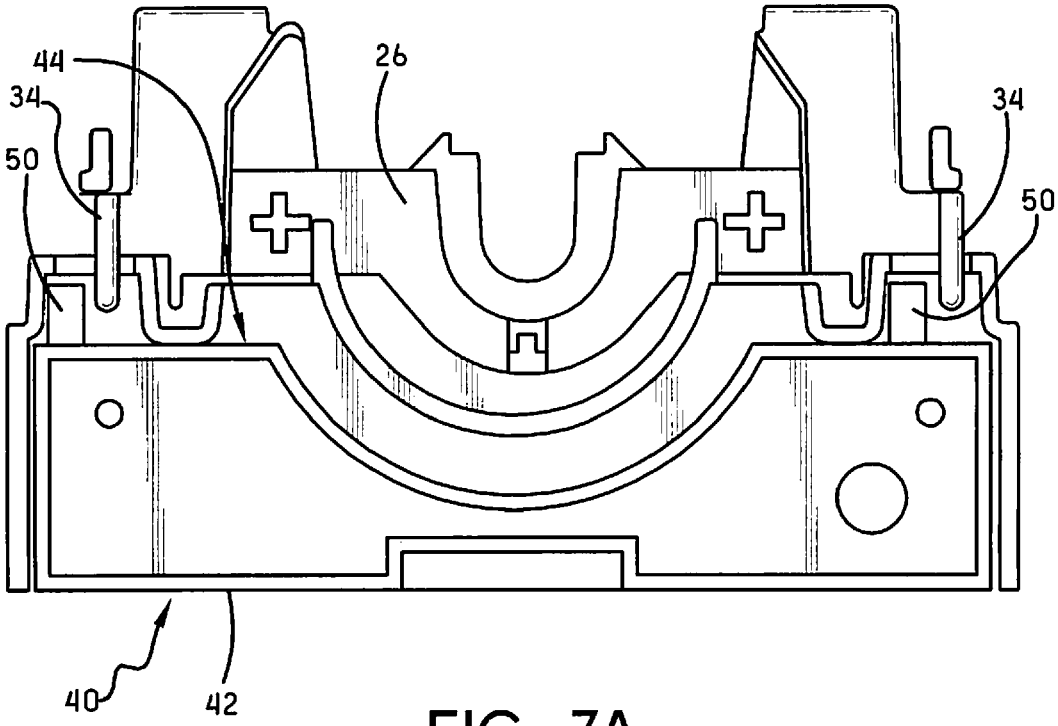
FIG. 7A is a top plan view showing the slide box assembly with the slide bar in the open position and interacting with other components of a dispenser constructed according to the concepts of the present invention.
Figure 7B:
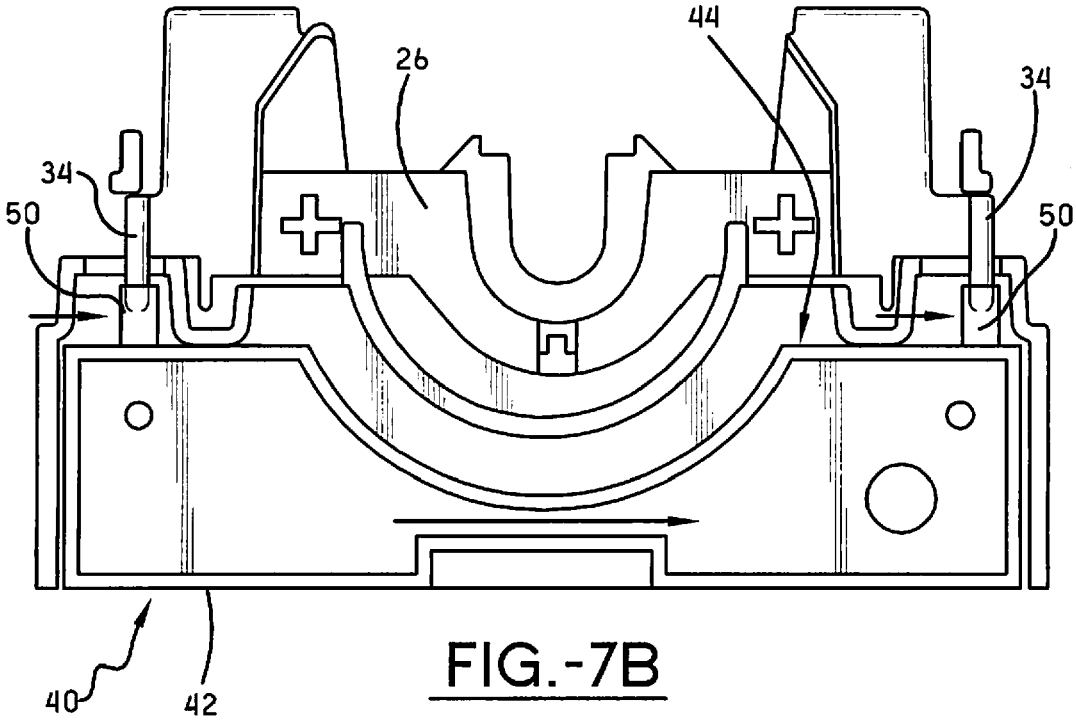
FIG. 7B is a top plan view similar to FIG. 7A, but with the slide bar in the closed position, thereby limiting the movement of the other components of the dispenser.

FIGS. 7A and 7B show how slide box assembly 40 may be used as a lockout device to limit the operation of dispenser 10. FIG. 7A is a top view showing the relationship between the dispenser's operational components, including actuator carriage 26 and slide box assembly 40, when slide bar 48 is in the open position. Again, actuator carriage 26 interfaces with a pump mechanism associated with container 16, and vertical movement of actuator carriage 26 causes actuation of the pump mechanism, leading to the dispensing of soap. As mentioned, actuator carriage 26 includes engagement tabs 34 which are designed for engagement with stop tabs 50. When slide bar 48 is in the open position (as in FIG. 7A), engagement tabs 34 do not engage stop tabs 50, and actuator carriage 26 is free to move in the vertical direction of pathways 32.

Thus, the dispenser may be freely operated. However, when slide bar 48 is in the closed position (as in FIG. 7B), engagement tabs 34 engage stop tabs 50, and the vertical movement of actuator carriage 26 is thereby limited. By positioning slide box assembly 40 appropriately with respect to actuator carriage 26 (so that slide box assembly 40 is immediately above the actuator carriage 26 when the actuator carriage is in its starting position), vertical movement of actuator carriage 26 can be eliminated entirely. With its movement eliminated, or appropriately limited, actuator carriage 26 is unable to act on the pump mechanism associated with container 16, thereby limiting the operation of dispenser 10 and preventing it from dispensing soap. Thus, slide box assembly 40 serves as a lockout device to selectively limit the operation of the dispenser. Limiting the operation of the dispenser may be desirable, for instance, if an inappropriate refill container is installed in the dispenser.

Returning to FIG. 4, control of the movement of slide bar 48 will now be described. Latch mechanism 60 is actuated by, and latch tooth 62 is caused to rotate by, an activation wire 68. Activation wire 68 is made from a shape memory alloy material. Shape memory alloys (SMAs) are alloys that "remember" a particular shape and can be returned to that shape after being deformed by applying heat to the alloy. SMAs are generally known, and include, for instance, alloys of copper-zinc-aluminum-nickel, copper-aluminum-nickel, and nickel-titanium. Wire 68 is anchored at and in electronic contact with a wire mount 70. Wire 68 extends from wire mount 70 and is connected to latch mechanism 60 above axis 63, such as at a latch post 65. Alternatively, wire 68 could extend from wire mount 70 proximate a first end of wire 68, go around latch post 65 and be connected again at wire mount 70 proximate a second end of wire 68. Of course, other means of connecting wire 68, wire mount 70 and latch mechanism 60 are possible and will be apparent to those in the art. In any event, when a current is applied to wire 68, the wire 68 is heated and its intrinsic qualities cause it to change shape and cause a movement in latch mechanism 60, creating a torque in the same. This torque overcomes any biasing force in the latch mechanism toward notch 52 and causes latch tooth 62 to rotate away from notch 52. By wrapping wire 68 around latch post 65, as shown in FIG. 4, the length of wire 68 is effectively doubled. It is known that SMA wires contract in proportion to the total length of the wire, so increasing the length of wire 68 increases the amount of contraction in wire 68, which thereby increases the amount of work put toward the rotation of latch mechanism 60.

If latch tooth 62 is at first engaged with notch 52, such as in the configuration shown in FIG. 4, and a current is applied to wire 68, latch tooth 62 is rotated and comes out of engagement with notch 52. No longer held in position by latch tooth 62, slide bar 48 is pushed by the biasing force of torsion spring 58 and moves in the lateral direction toward latch mechanism 60. In other words, when slide bar 48 is engaged by latch tooth 62, it is in the first, or open, position. When the latch tooth 62 is removed from notch 52, slide bar 48 is caused to move to the second, or closed position.

Current may be selectively applied to activation wire 68 in the form of an activation signal 72 provided by a controller 74. Controller 74 is part of dispenser 10 and receives and provides instructions to various other electrical components that may be included in dispenser 10. While not intended to be an exhaustive list, such other electrical components may include visual or auditory indicia, sensors, and the like. In the embodiment shown, controller 74 may be associated with an RFID receiver 76 (which may also be known as an RFID reader) that is incorporated into dispenser 10 for the purpose of identifying refill containers based on the refill containers having associated therewith particular RFID tags. RFID receivers and tags are well known in the art. RFID receiver 76 may be configured to provide an instruction signal 78 to controller 74 based on the nearby presence of an appropriate RFID tag, such as when the RFID tag is affixed to a refill container that is installed in dispenser 10. RFID receiver 76 may be configured to periodically query for nearby RFID tags. If RFID receiver 76 receives an appropriate response (i.e., a response from an RFID tag having a particular and anticipated quality, such as frequency), no action is taken. If RFID receiver 76 does not receive an appropriate response to its query, because of the absence of an appropriate RFID tag nearby, RFID receiver 76 sends instruction signal 78 to controller 74.

When an appropriate refill container is used in dispenser 10, controller 74 does not send an activation signal 72 to activation wire 68. As discussed, when slide bar 48 is held in the open position by latch tooth 62, pushbar 18 may be depressed and the dispenser freely operated. However, when an inappropriate refill container is used in dispenser 10, or when controller 74 receives an instruction signal 78 from RFID receiver 76, controller 74 provides an activation signal 72 to activation wire 68. When activation signal 72 is applied to activation wire 68, which may be through wire mount 70, in the form of current, latch mechanism 60 is acted on, causing latch tooth 62 to rotate. Thus, when latch tooth 62 is caused to rotate so that it no longer engages notch 58, slide bar 48 will be moved to the closed position. Once in the closed position, stop tabs 50 prohibit actuator carriage 26 from moving upward, thereby limiting operation of dispenser 10.

Once slide bar 48 is in the closed position and the operation of the dispenser is limited, a user will be unable to dispense any product S. This will either cause the user to give up using the dispenser or to investigate the problem further. If the user investigates the problem and opens dispenser 10 by using the opening bar 39, as those skilled in the dispenser arts understand to do, the lockout device will be mechanically reset so the slide bar 48 is returned to the open position. This resetting will be discussed primarily with reference to FIGS. 8A, 8B and 8C. As it is known to do, the opening bar 39 may be moved in the upward vertical direction to disengage cover 12*b* from backplate 12*a*, thereby opening dispenser 10. Thus a user may gain access to the space within the housing 12 of dispenser 10 and may inspect container 16 or any other components contained within dispenser 10. In addition to opening the dispenser, operation of opening bar 39 is related to resetting the lockout device. As previously discussed, dispenser 10 includes an L-shaped reset arm 41. As shown in FIGS. 3, 8A, 8B and 8C, reset arm 41 (which is transparent in FIGS. 8A, 8B and 8C to show various features immediately behind the reset arm) is positioned at approximately the same vertical position as slide bar 48 and is designed to come into contact with reset notch 47 on slide bar 48. Reset arm 41 includes on its front facing surface a guide pin 45 that rides in a track surface 49 of opening bar 39. Track surface 49, through its relationship with guide pin 45, defines the movement of reset arm 41 as opening bar 39 is moved in the vertical direction, which movement is best understood with reference to the figures. As those of skill in the art will appreciate, upward vertical movement of opening bar 39 causes rotational movement of reset arm 41, and in the embodiment shown, this rotational movement is in the upward, or clock-wise direction. Conversely, downward vertical movement of opening bar 39 causes rotational movement of reset arm 41 in the opposite direction, or in the downward, counter-clock-wise direction. As those of skill in the art will also appreciate, the shape of reset arm 41 may take other forms than the L-shape, and the position of guide pin 45 and contour of track surface 49 may be modified to create the desired movement in reset arm 41.

Figure 8A:
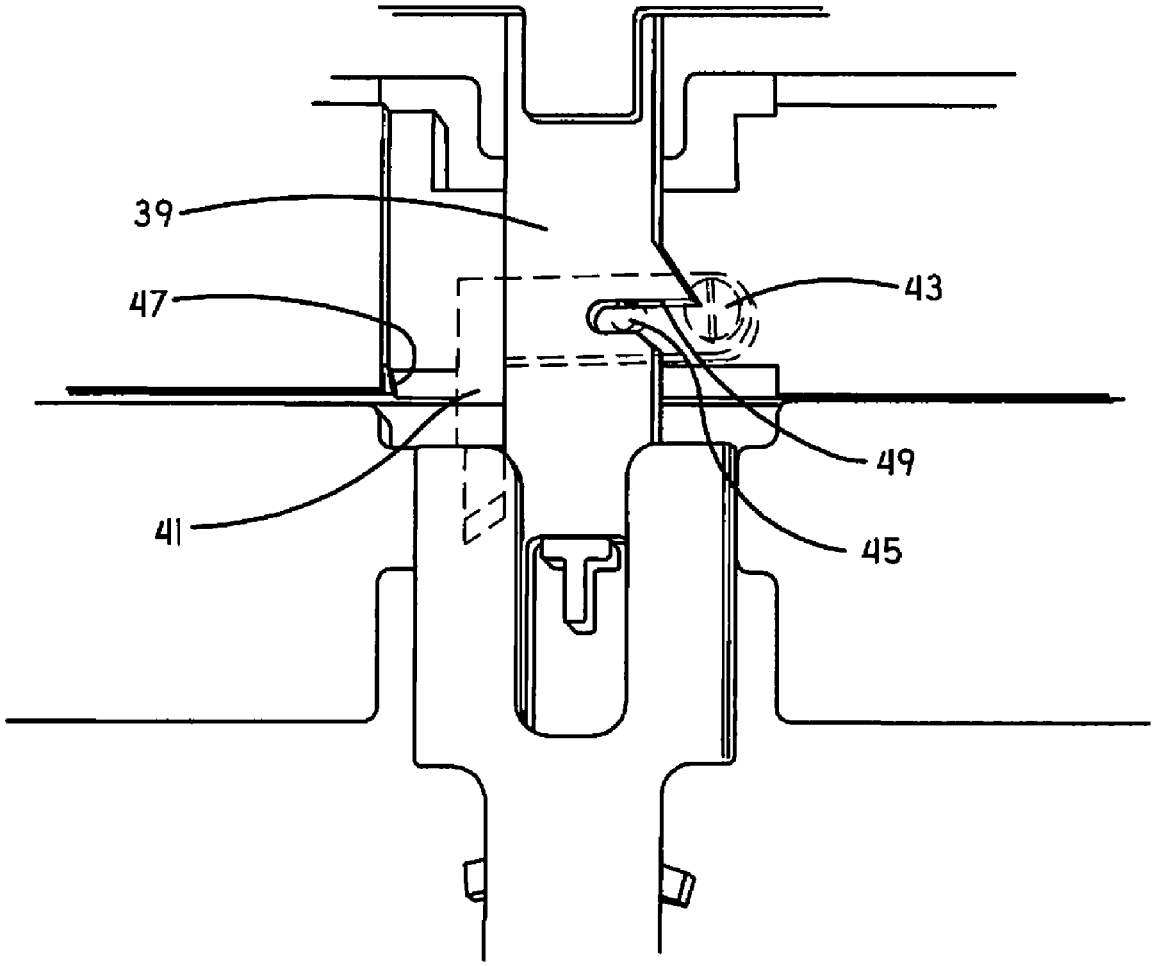
FIG. 8A is a close-up view of a portion of the rear of the dispenser of FIG. 3, showing the L-shaped reset arm and the slide bar in the open position.

Turning to the figures, FIG. 8A shows slide bar 48 in the open position and opening bar 39 in a rest position. As will be appreciated, if a user were to move opening bar 39 upward when slide bar 48 is in the open position, reset arm 41 will rotate in the clock-wise direction without coming into contact with slide bar 48.

Figure 8B:
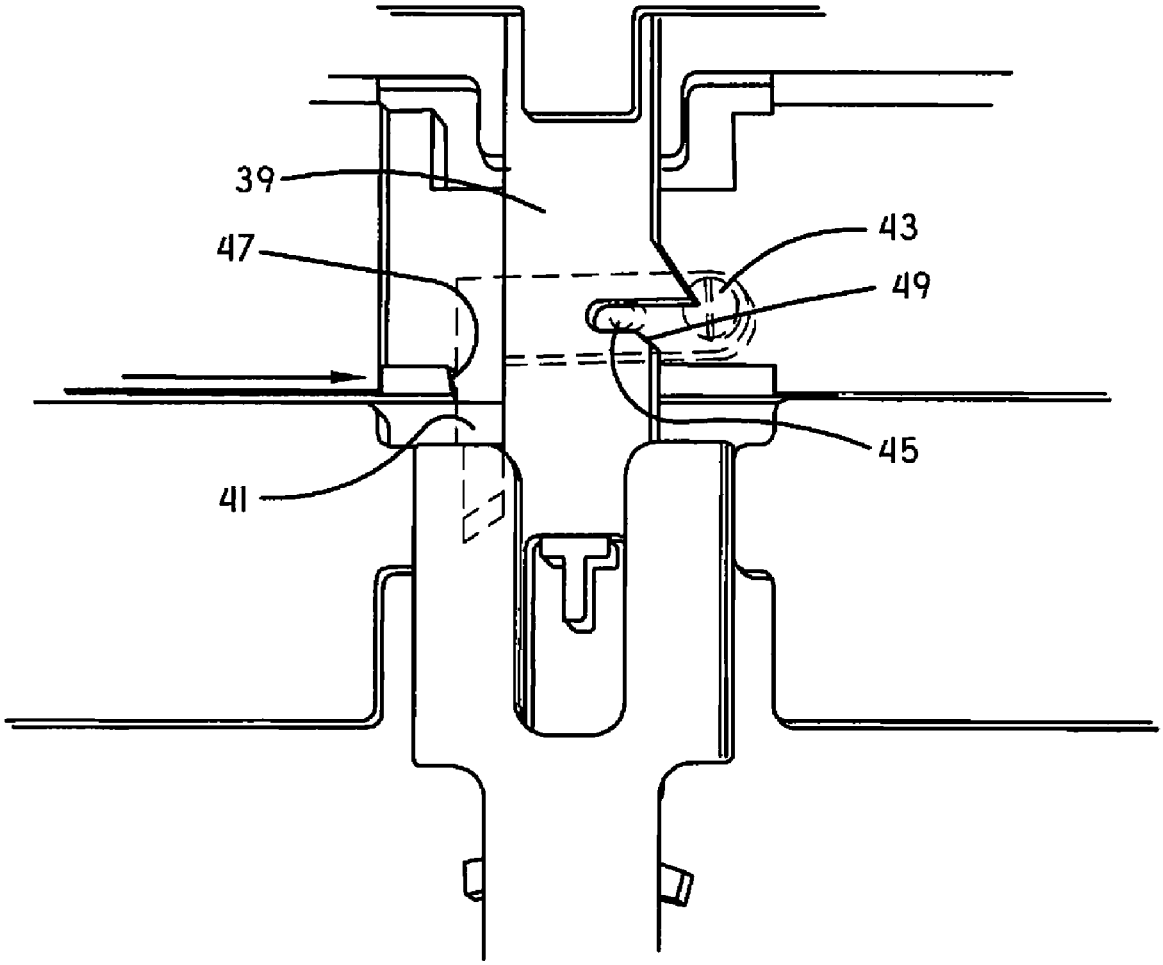
FIG. 8B is the same close-up view of FIG. 8A, but showing the slide bar in the closed position.
Figure 8C:
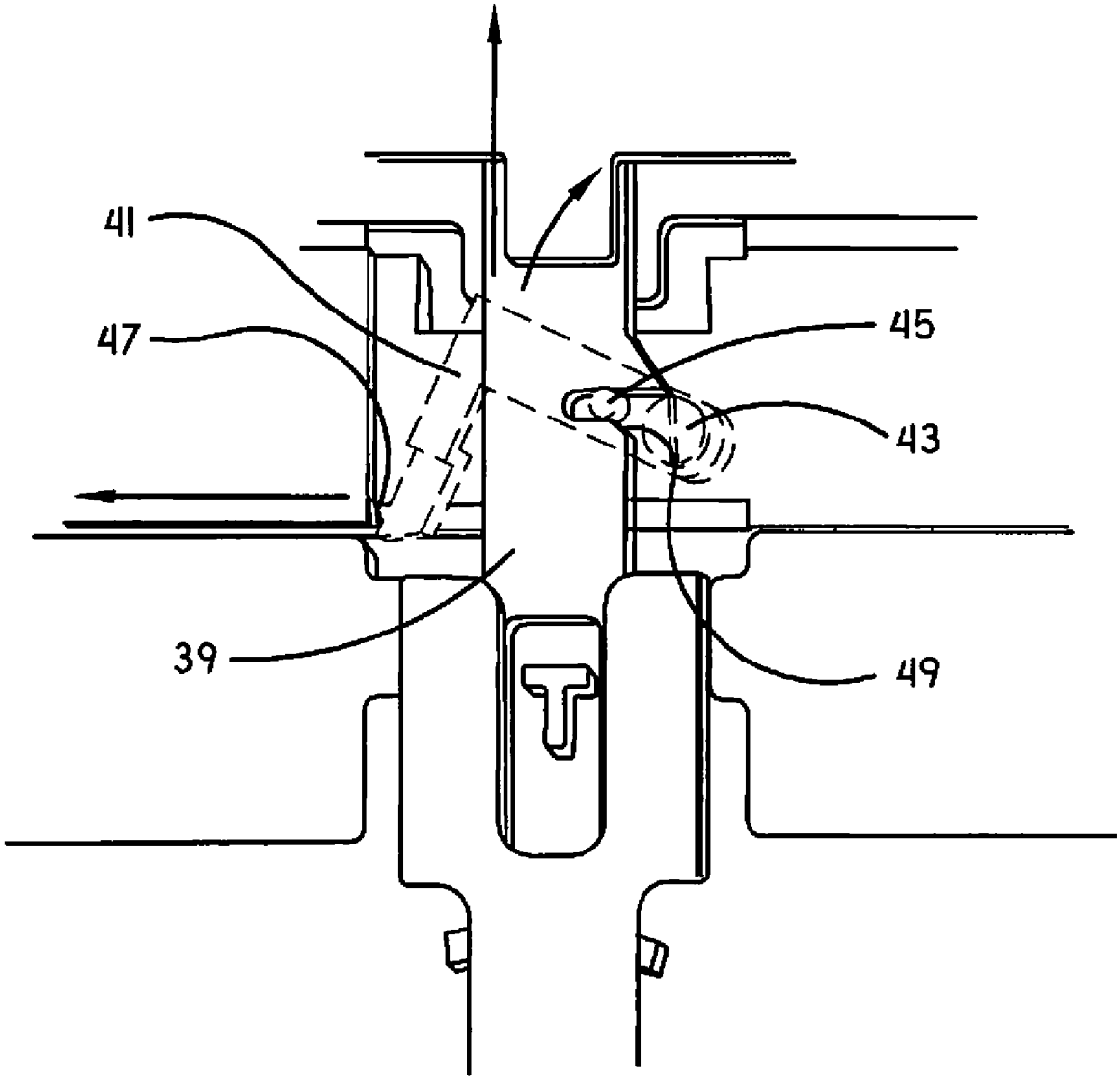
FIG. 8C is the same close-up view of FIG. 8A, but showing the reset arm push the slide bar back toward the open position as the opening bar is moved in an upward vertical direction.

FIG. 8B, in turn, shows slide bar 48 in the closed position. Again, the upward vertical movement of opening bar 39 causes slide bar 48 to be moved from the closed position to the open position, such movement being understood with reference to FIG. 8C. When slide bar 48 is in the closed position (as in FIG. 8B), reset notch 47 on slide bar 48 is nearer reset arm 41 than when slide bar 48 is in the open position (as in FIG. 8A). When opening bar 39 is moved upwardly, reset arm 41 is caused to rotate in the upward, clock-wise direction. As reset arm 41 moves upwardly in the clock-wise direction, it comes into contact and bears against reset notch 47, thereby pushing slide bar 48 toward the open position and against the biasing force of torsion spring 58. When slide bar 48 reaches the open position, the biasing torque on latch mechanism 60 moves latch tooth 62 into notch 52, thereby holding slide bar 48 in the open position. The user then continues to move opening bar 39 further in the upward direction until cover 12*b* is disengaged from backplate 12*a*, thereby opening dispenser 10. When the user releases opening bar 39, it falls vertically downward to its original rest position without contacting reset notch 47 of slide bar 48, which is now held in the open position. Thus, upward vertical movement of opening bar 39 causes the mechanical reset of the lockout device, and the movement of slide bar 48 from the closed position to the open position. Once dispenser 10 is opened, the user can inspect the contents thereof, and install an appropriate refill container therein. Again, if an appropriate refill container is installed in dispenser 10, the lockout device will not be activated and slide bar 48 will remain in the open position, thereby allowing the unimpeded operation of the dispenser.

Dispensers constructed according to the concepts of the present invention offer several advantages over prior art forms. Principally, the present invention provides a physical means of preventing the operation of a dispenser unless an appropriate refill container is installed in the dispenser. Moreover, the present invention provides a mechanical means for resetting the lockout device once it is activated and moved to a closed position.

Thus, it can be seen that the objects of the invention have been satisfied by the structure and its method for use presented above. While in accordance with the Patent Statutes, only the best mode and preferred embodiment has been presented and described in detail, it is to be understood that the invention is not limited thereto or thereby. Accordingly, for an appreciation of the true scope and breadth of the invention, reference should be made to the following claims.

The invention claimed is:

1. A dispenser housing that receives a refill unit including a container and pump associated with the container to pump contents from the container, the dispenser housing comprising:

an actuator carriage moveable between a rest position and an actuated position, wherein, when a refill unit is received in the dispenser housing, movement of the actuator carriage from said rest position to said actuated position actuates the pump of the refill unit;

an engagement tab extending from said actuator carriage;

a lockout device moveable between an open position and a closed position, wherein, when said lockout device is in said open position, said actuator carriage is movable from said rest position to said actuated position, and, when said lockout device is in said closed position, movement of said actuator carriage is blocked by said lockout device such that said actuator carriage cannot be moved from said rest position to said actuated position, said lockout device including:

a slide bar, a notch in said slide bar, a latch having a latch post and a tooth, said tooth selectively engaging said notch, wherein, when said tooth engages said notch, said lockout device is held in said open position, and, when said tooth is disengaged from said notch, said lockout device is forced to said closed position, a stop tab extending from said lockout device, a shape memory alloy wire, said shape memory alloy wire causing said latch to disengage from said notch when a current is applied to said shape memory alloy wire, the current causing said shape memory alloy wire to change shape, a wire mount, wherein said shape memory alloy wire has a first end and a second end, and said shape memory alloy wire extends from said wire mount proximate said first end, wraps around said latch post, and is attached to said wire mount proximate said second end, wherein, when said lockout device is in said open position, said engagement tab and said stop tab are unaligned in the direction of travel of said actuator carriage as it moves from said rest position to said actuated position, and, when said lockout device is in said closed position, said engagement tab and said stop tab are aligned in the direction of travel of said actuator carriage as it moves from said rest position toward said actuated position, the alignment of said engagement tab and said stop tab preventing the movement of said actuator carriage from said rest position to said actuated position due to contact between the engagement tab and stop tab.

2. The dispenser housing of claim 1, further including:

an opening bar for opening said dispenser housing, said opening bar including a track surface, and a reset arm having a guide pin, wherein said guide pin rides in said track surface.

3. A dispenser housing that receives a refill unit including a container and pump associated with the container to pump contents from the container, the dispenser housing comprising:

an actuator carriage moveable between a rest position and an actuated position, wherein, when a refill unit is received in the dispenser housing, movement of the actuator carriage from said rest position to said actuated position actuates the pump of the refill unit;

an engagement tab extending from said actuator carriage;

a lockout device moveable between an open position and a closed position, wherein, when said lockout device is in said open position, said actuator carriage is movable from said rest position to said actuated position, and, when said lockout device is in said closed position, movement of said actuator carriage is blocked by said lockout device such that said actuator carriage cannot be moved from said rest position to said actuated position, said lockout device including:

a slide bar, a notch in said slide bar, a latch having a tooth that selectively engages said notch, wherein, when said tooth engages said notch, said lockout device is held in said open position, and, when said tooth is disengaged from said notch, said lockout device is forced to said closed position, a stop tab, a shape memory alloy wire, said shape memory alloy wire causing said latch to disengage from said notch when a current is applied to said shape memory alloy wire, the current causing said shape memory alloy wire to change shape; and a controller, said controller controlling said current applied to said shape memory alloy wire, wherein, when said lockout device is in said open position, said engagement tab and said stop tab are unaligned in the direction of travel of said actuator carriage as it moves from said rest position to said actuated position, and, when said lockout device is in said closed position, said engagement tab and said stop tab are aligned in the direction of travel of said actuator carriage as it moves from said rest position toward said actuated position, the alignment of said engagement tab and said stop tab preventing the movement of said actuator carriage from said rest position to said actuated position due to contact between the engagement tab and stop tab.

4. The dispenser housing of claim 3, wherein said latch has an irregular cam shape and is pivotable about an axis.

5. The dispenser housing of claim 4, wherein said shape memory alloy wire is attached to said latch above said axis.

6. The dispenser housing of claim 3, wherein said lockout device further includes:

a wire mount, wherein said shape memory alloy wire extends between said wire mount and said latch.

7. The dispenser housing of claim 6, wherein said latch further includes a latch post, said shape memory alloy wire extending from said wire mount and wrapping around said latch post.

8. The dispenser housing of claim 7, wherein said shape memory alloy wire has a first end and a second end, and said shape memory alloy wire extends from said wire mount proximate said first end, wraps around said latch post, and is attached to said wire mount proximate said second end.

9. The dispenser housing of claim 3, further including:

an RFID receiver associated with said controller, said RFID receiver being configured to provide instruction signals to said controller based on the nearby presence of an appropriate RFID tag.

10. A dispenser housing that receives a refill unit including a container and pump associated with the container to pump contents from the container, the dispenser housing comprising:

an actuator carriage moveable between a rest position and an actuated position, wherein, when a refill unit is received in the dispenser housing, movement of the actuator carriage from said rest position to said actuated position actuates the pump of the refill unit;

an engagement tab extending from said actuator carriage;

a lockout device moveable between an open position and a closed position, wherein, when said lockout device is in said open position, said actuator carriage is movable from said rest position to said actuated position, and, when said lockout device is in said closed position, movement of said actuator carriage is blocked by said lockout device such that said actuator carriage cannot be moved from said rest position to said actuated position, said lockout device including:

a slide bar, a notch in said slide bar, a latch having a tooth that selectively engages said notch, wherein, when said tooth engages said notch, said lockout device is held in said open position, and, when said tooth is disengaged from said notch, said lockout device is forced to said closed position, a stop tab, a shape memory alloy wire, said shape memory alloy wire causing said latch to disengage from said notch when a current is applied to said shape memory alloy wire, the current causing said shape memory alloy wire to change shape, wherein when said refill unit is an appropriate refill unit, said actuator carriage is moveable between the rest position and the actuated position, and when said refill unit is an inappropriate refill unit, said lockout device is in said closed position and the alignment of said engagement tab and said stop tab prevent the movement of said actuator carriage from said rest position to said actuated position.

11. The dispenser housing of claim 10, further including:

a controller, said controller controlling said current applied to said shape memory alloy wire.

12. A dispenser housing that receives a refill unit including a container and pump associated with the container to pump contents from the container, the dispenser housing comprising:

an actuator carriage moveable between a rest position and an actuated position, wherein, when a refill unit is received in the dispenser housing, movement of the actuator carriage from said rest position to said actuated position actuates the pump of the refill unit;

a lockout device moveable between an open position and a closed position, wherein, when said lockout device is in said open position, said actuator carriage is movable from said rest position to said actuated position, and, when said lockout device is in said closed position, movement of said actuator carriage is blocked by said lockout device such that said actuator carriage cannot be moved from said rest position to said actuated position;

an opening bar for opening said dispenser housing, said opening bar including a track surface;

a reset arm having a guide pin, wherein said guide pin rides in said track surface; and a slide bar having a reset notch, wherein, when said opening bar is moved upwardly, said reset arm is caused to come into contact with and bear against said reset notch.

13. The dispenser housing of claim 12, further comprising:

an engagement tab extending from said actuator carriage; and a stop tab extending from said lockout device, wherein, when said lockout device is in said open position, said engagement tab and said stop tab are unaligned in the direction of travel of said actuator carriage as it moves from said rest position to said actuated position, and, when said lockout device is in said closed position, said engagement tab and said stop tab are aligned in the direction of travel of said actuator carriage as it moves from said rest position toward said actuated position, the alignment of said engagement tab and said stop tab preventing the movement of said actuator carriage from said rest position to said actuated position due to contact between the engagement tab and stop tab.

14. The dispenser housing of claim 13, wherein said lockout device includes:

a slide bar;

a notch in said slide bar;

a latch having a tooth that selectively engages said notch, wherein, when said tooth engages said notch, said lockout device is held in said open position, and, when said tooth is disengaged from said notch, said lockout device is forced to said closed position.

15. The dispenser housing of claim 14, wherein said lockout device further includes:

a spring, said spring imparting a biasing force on said slide bar, wherein when said tooth of said latch is disengaged from said notch, said spring moves said slide bar and said lockout device is forced to said closed position.

* * * * *